US005759072A

United States Patent [19]

Chadbourne et al.

[11] Patent Number: 5,759,072

[45] Date of Patent: Jun. 2, 1998

[54] CLIP-ON LAY-IN CONNECTOR

[75] Inventors: Richard Chadbourne, Merrimack; Keith Mello; Gennaro L. Pecora, both of Manchester, all of N.H.

[73] Assignee: Framatome Connectors USA Inc., Manchester, N.H.

[21] Appl. No.: 856,790

[22] Filed: May 15, 1997

Related U.S. Application Data

[63] Continuation of Ser. No. 588,428, Jan. 18, 1996, abandoned.

[51] Int. Cl.[6] ..... H01R 4/36

[52] U.S. Cl. ..... 439/814

[58] Field of Search ..... 439/810–814, 439/100

[56] References Cited

U.S. PATENT DOCUMENTS

| | | | |
|---|---|---|---|
| 2,179,575 | 11/1939 | Hosking | 411/163 |
| 2,423,627 | 7/1947 | Tinnerman | 439/100 |
| 2,778,399 | 1/1957 | Mroz | 411/164 |
| 2,976,514 | 3/1961 | Stanback et al. | 439/814 |
| 5,030,131 | 7/1991 | Boehm | 439/810 |

*Primary Examiner*—Gary F. Paumen

*Attorney, Agent, or Firm*—Perman & Green, LLP

[57] ABSTRACT

A conductor is formed from a single unitary sheet of metal and is bent so as to form a body portion and two overlapped flange sections. The flange section which is immediately adjacent the contact surface to which the conductor is connected may include at least one surface scratching projection which extends outwardly beyond the undersurface of that flange section to scratch and make electrical contact with the contact surface to permit electric flow between the conductor and the contact surface.

12 Claims, 8 Drawing Sheets

FIG. 1
PRIOR ART
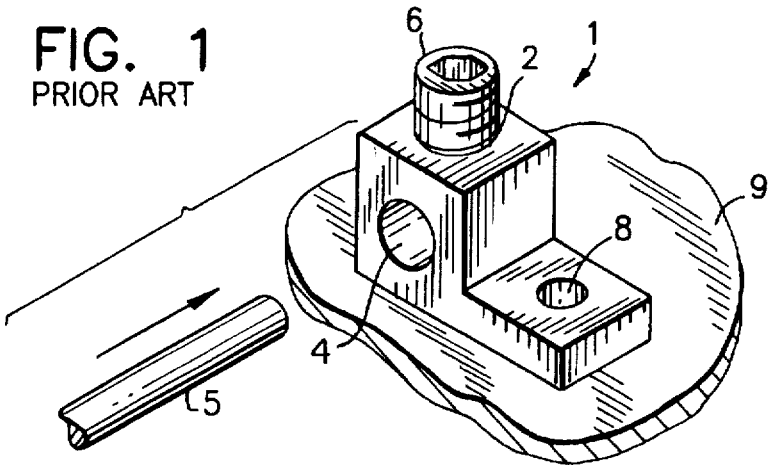
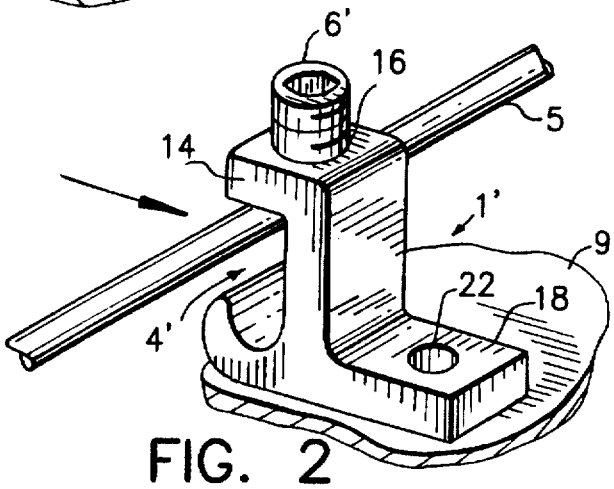
FIG. 2
PRIOR ART
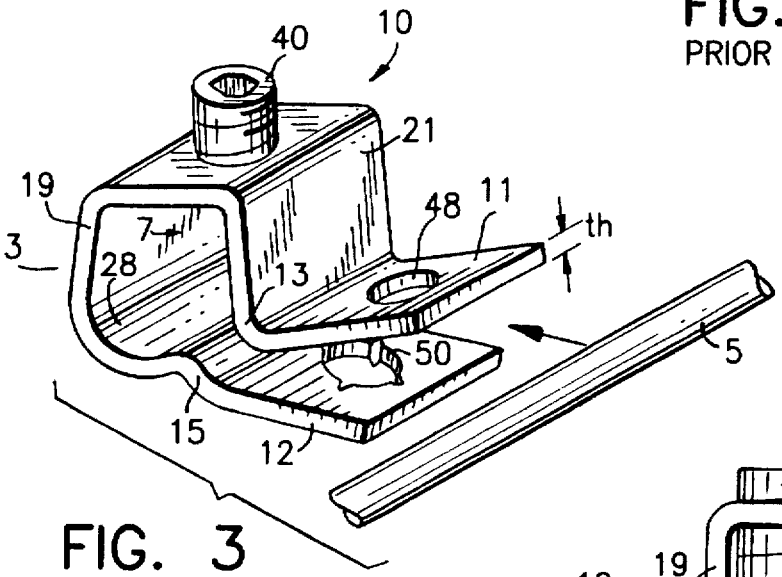
FIG. 3
FIG. 4
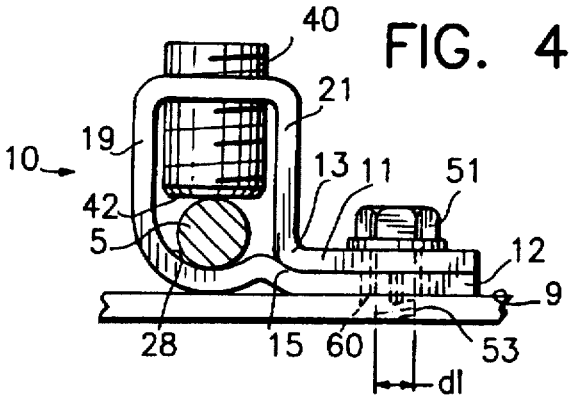

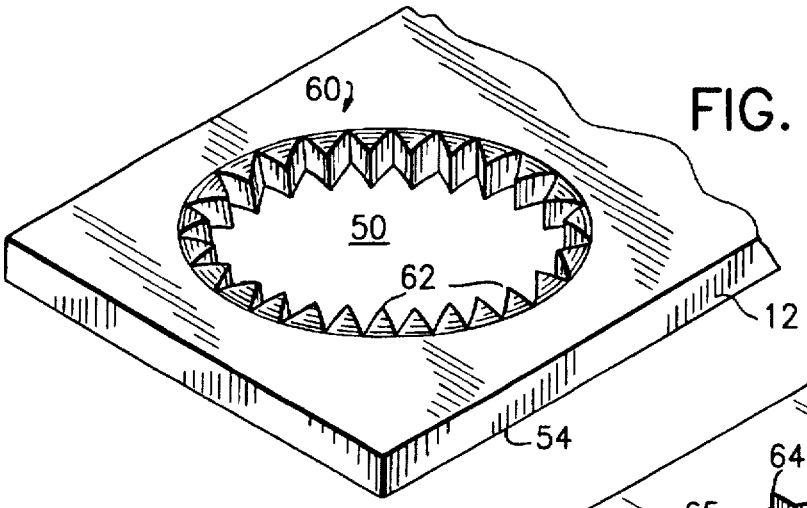
FIG. 9a
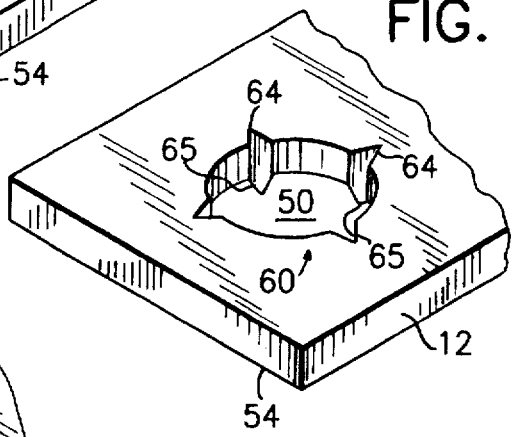
FIG. 9b
FIG. 9c
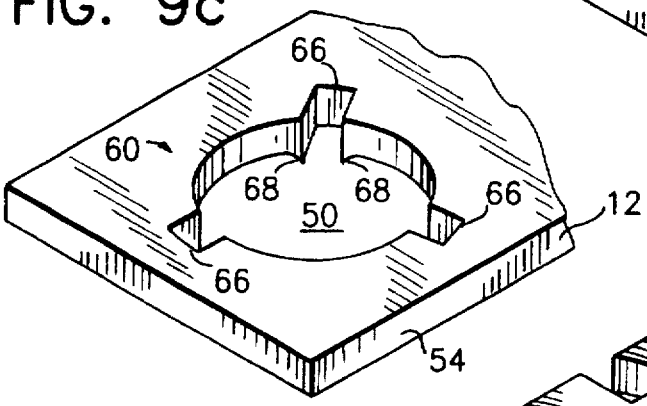
FIG. 10a
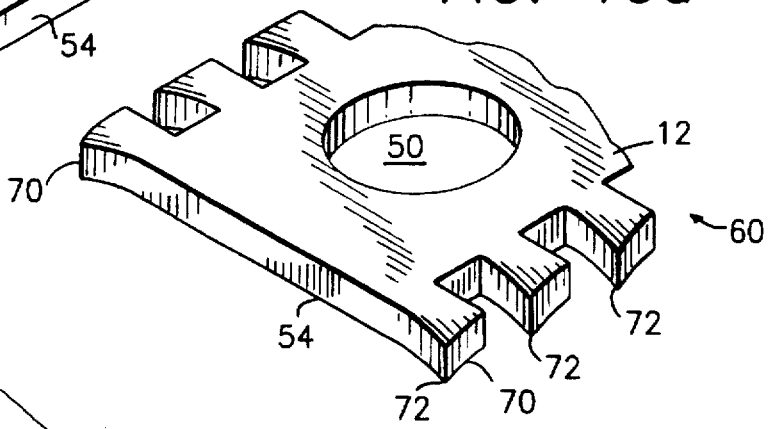
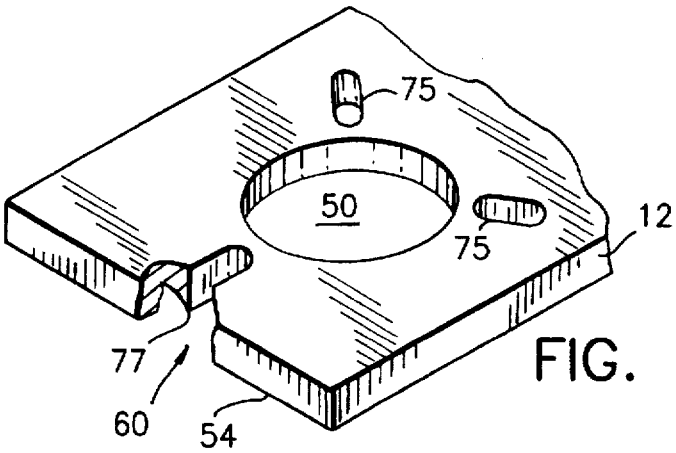
FIG. 10b FIG. 11a
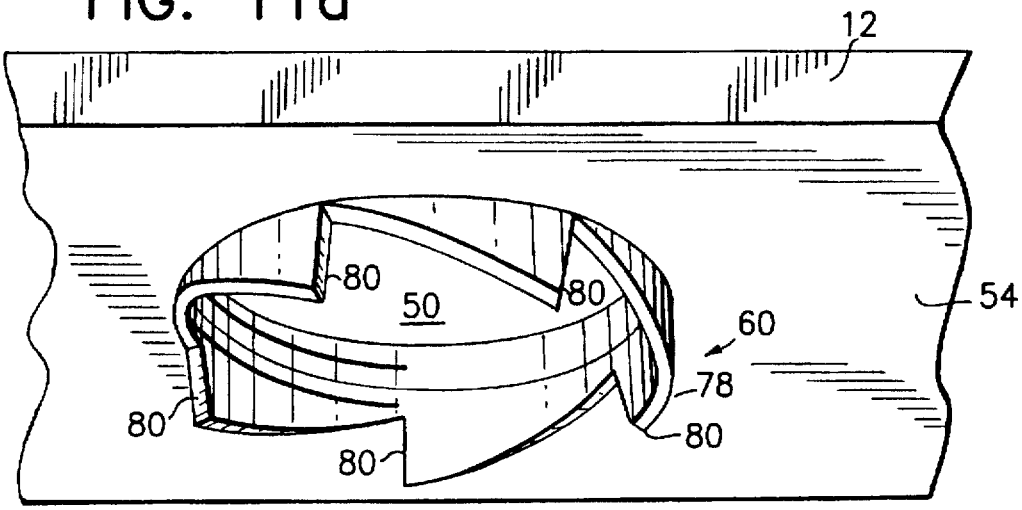
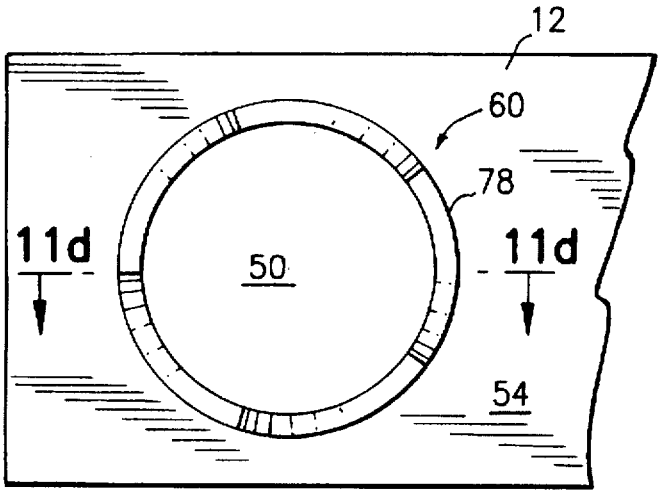
FIG. 11b
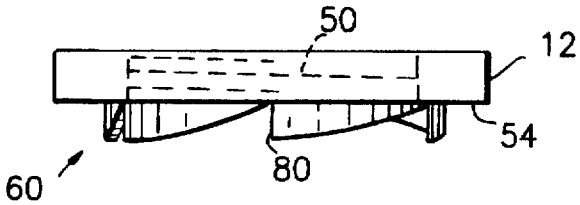
FIG. 11c
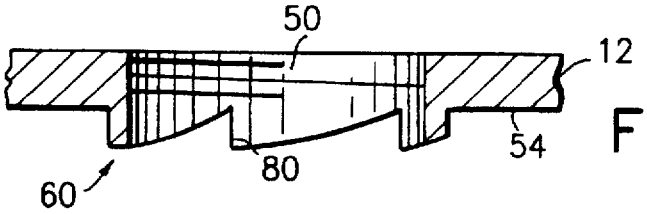
FIG. 11d FIG. 12a
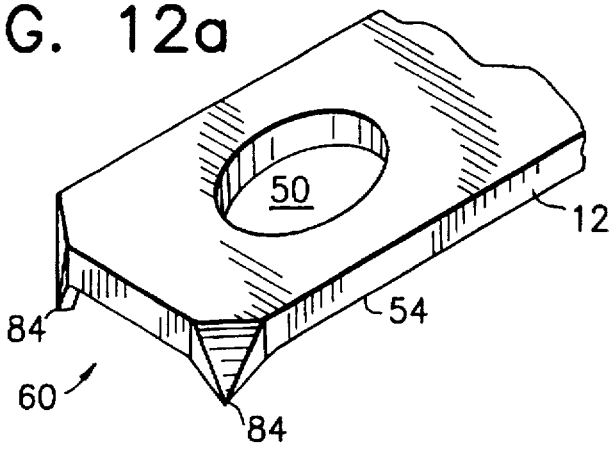
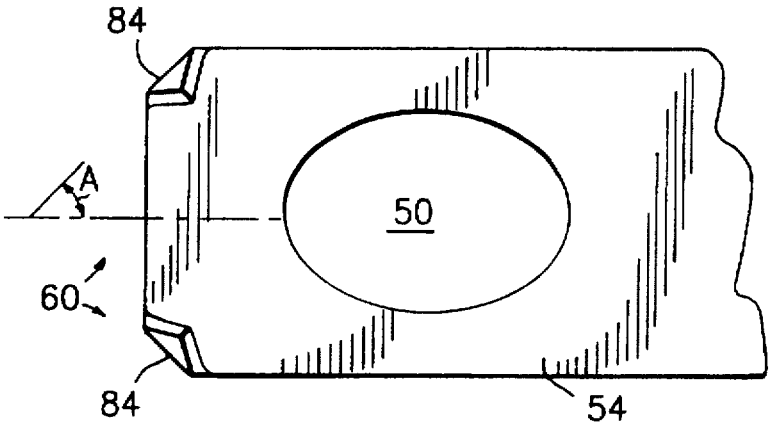
FIG. 12b
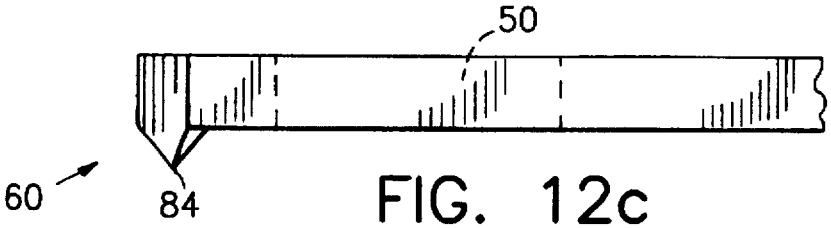
FIG. 12c
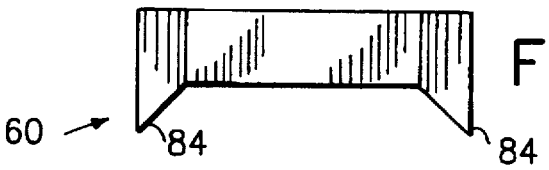
FIG. 12d

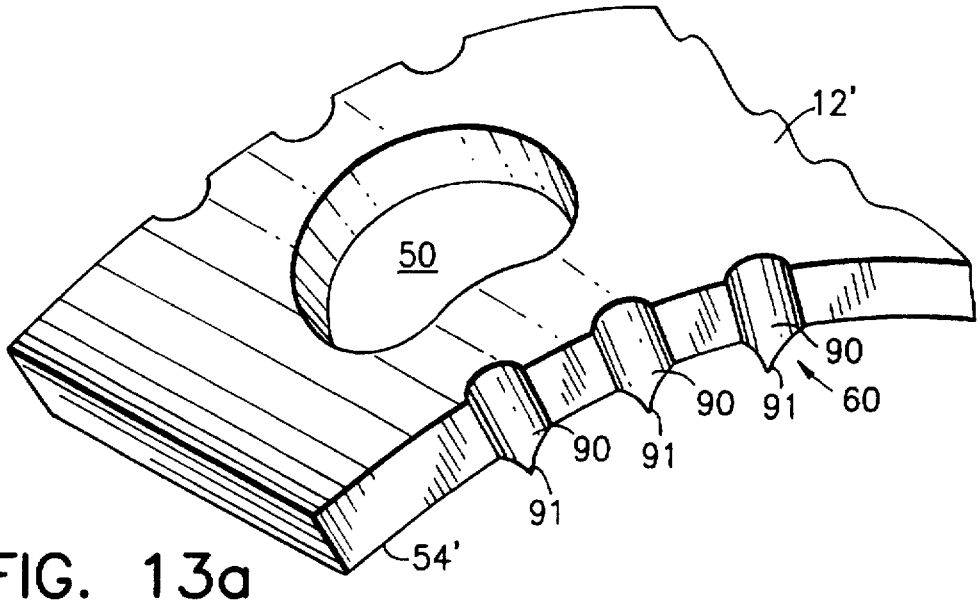
FIG. 13a
FIG. 13b
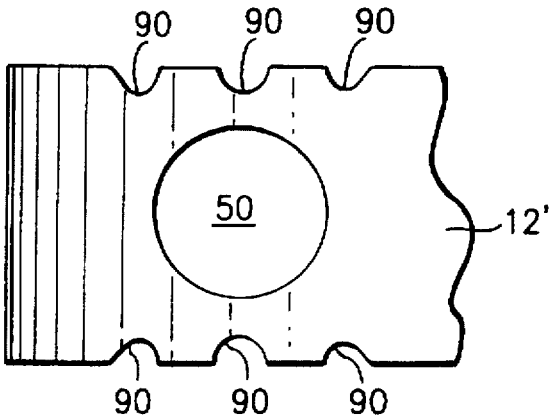
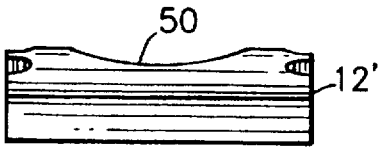
FIG. 13d
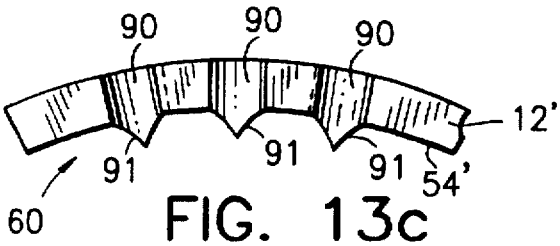
FIG. 13c
FIG. 13e
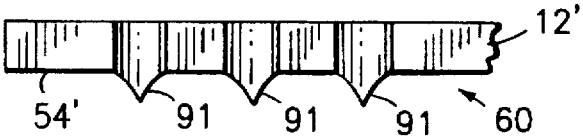

CLIP-ON LAY-IN CONNECTOR

This application is a continuation of application Ser. No. 08/588,428 filed on Jan. 18, 1996, now abandoned.

BACKGROUND OF THE INVENTION

The present invention relates to an electrical connector, and deals more particularly with a low cost lay-in type connector which connects a conductor to a surface between which current may pass.

Lay-in type connectors are known in the art. Examples of prior art connectors are shown in FIGS. 1 and 2. The prior art connector shown in FIG. 1 is a block type connector 1 wherein the connector is formed from a solid piece of metal with a set screw receiving opening 2 and a conductor receiving opening 4 which intersect with one another. The set screw opening 2 is correspondingly sized and shaped to receive a threaded set screw 6 which compresses and clamps the conductor 5 within the conductor receiving opening 4. A portion of the connector 1 also has an opening 8 which receives a mounting bolt (not shown) for securing the connector to a contact surface 9. An electrical connection between the conductor 5 and the surface 9 is hence effected by the clamping action of the set screw upon the conductor and by the tightening action of the mounting bolt upon the contact surface 9.

In the prior art device shown in FIG. 2, the connector 1' is comprised of a lug formed from an extruded piece of metal which has an open lateral side face defined by a generally J-shaped receiving notch 4'. Disposed immediately above the notch 4' is a horizontally extending flange 14 in which is formed a threaded opening 16. The threaded opening 16 receives a set screw 6' for the purpose of clamping the conductor 5 to the J-shaped notch. The body portion of the lug also includes a lateral extension portion 18 having an opening 22 for receiving a mounting bolt which is in turn threaded into a corresponding threaded opening formed in the contact surface 9.

The aforementioned prior art devices all involve significant manufacturing costs associated with their fabrication, such as in the processes of extruding and milling. Also, in the event that the contact surface is covered with a thin layer of dielectric material which would prevent current flow therethrough, stemming, for example, from the surface being painted or possibly oxidized, such prior art devices are not readily constructed to effect surface scratching or to prevent unwanted rotation of the connector once it is engaged with the contact surface. Additionally, where installation requires that the connector be installed in environments where the contact surface my be dirty, providing surface scratching capabilities on the connector would readily advance the installation process.

Accordingly, it is an object of the invention to provide an improved lay-in type connector wherein the connector is a low cost product which can be readily secured to a contact surface in a conventional manner.

Still a further object of the invention is to provide a connector of the aforementioned type wherein an electric connection between a conductor and a contact surface can be effected through a connector having preformed surface scratching elements which effect such conduction through a mechanical connection.

Still a further object of the invention is to provide an electrical connector of a reduced cost while having the strength of a milled or extruded connector.

SUMMARY OF THE INVENTION

The invention resides in an electrical lay in type connector comprised of a strip of sheet metal or other like material formed to define a body portion having an interior confine and first and second flange sections extending from the body portion. The first flange section and the second flange section each have a through opening formed therein substantially of the same diameter and being aligned with one another when the first and second flange sections are in an overlapping arrangement. One of the first and second flange sections defines an undersurface of the connector and has surface scratching means disposed proximate the opening therein and depending beyond the undersurface. The openings in the first and said second flange sections being adapted to receive a bolt which threads into a threaded opening in a contact surface or in a nut located on the opposite side of the contact surface with said surface scratching means engaging the contact surface when the bolt is tightened.

The body portion of the connector may employ a set screw to facilitate holding of the conductor within the confine, or may be appropriately sized to clamp around the conductor when the flange sections are urged together.

The surface scratching means may take may different forms, each defined by deformed areas of the metal making up the connector. Additionally, in certain applications, the invention may be practiced by a clip-on connector of the aforementioned type which does not employ any surface scratching means.

BRIEF OF THE DESCRIPTION OF THE PREFERRED EMBODIMENTS

FIG. 1 is a perspective view of a prior art connector.

FIG. 2 is a perspective view of another prior art connector.

FIG. 3 is a perspective view of the lay-in type connector of the present invention shown with the conductor set laterally apart.

FIG. 4 is a side elevation assembly view of the connector of FIG. 3 shown fastened to a contact surface with a conductor secured therewithin.

FIGS. 9A, 9B, 9C illustrate different variations of a first embodiment of surface scratching projections formed in the opening of the connector.

FIGS. 10A and 10B illustrate a second and third embodiments of surface scratching structure.

FIG. 11A illustrates in perspective a fourth embodiment of surface scratching structure.

FIG. 11B is a bottom plan view of the structure in FIG. 11A.

FIG. 11C is a front end view of the structure in FIG. 11B.

FIG. 11D is a vertical sectional view taken along line 11D—11D of FIG. 11B.

FIG. 12A is a perspective view of the fifth embodiment of the surface scratching structure.

FIG. 12B is a bottom plan view of the structure in FIG. 11A.

FIG. 12C is a side elevation view of the structure in FIG. 12A.

FIG. 12D is a front end view of the structure in FIG. 12C.

FIG. 13A is a perspective view of a sixth embodiment of the surface scratching structure taking the form of a curved lower flange section.

FIG. 13B of a partial fragmentary top plan view of the structure in FIG. 13A.

FIG. 13C is a side elevation view of the structure in FIG. 13B.

FIG. 13D is a front end view of the structure shown in FIG. 13C.

FIG. 13E is a side elevation view of the structure shown in FIG. 13C as it would appear in its flattened condition.

Figure 14A:
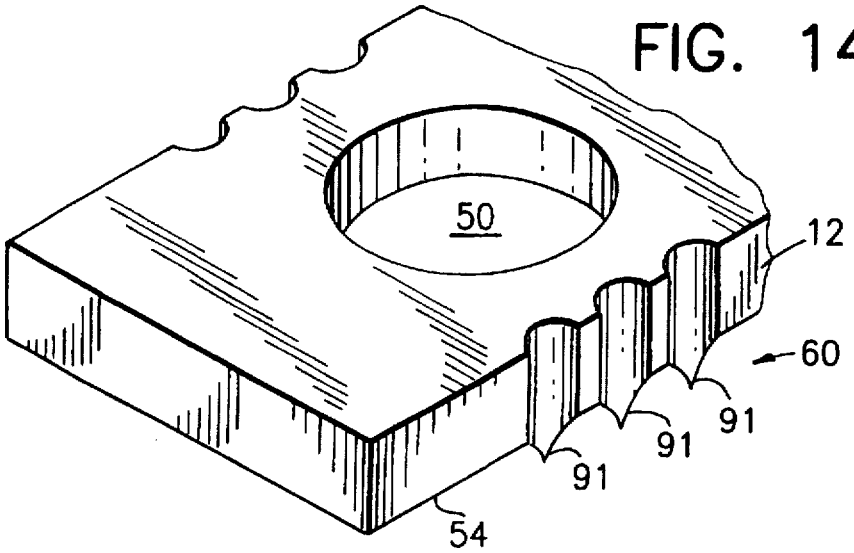

FIG. 14A is a perspective view of a seventh alternative embodiment of the surface scratching structure.

Figure 14B:
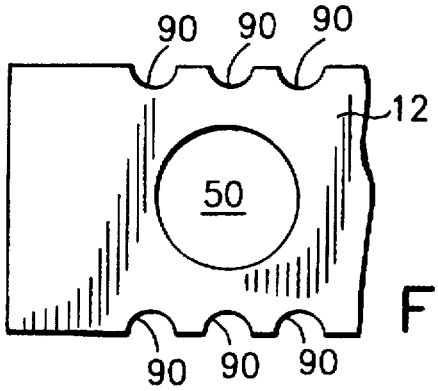

FIG. 14B is a bottom plan view of the structure of FIG. 14A.

Figure 14C:
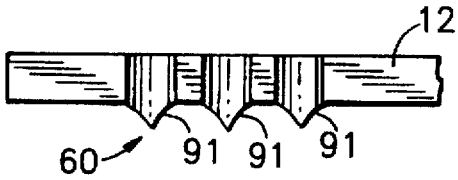

FIG. 14C is a side elevation view of the structure of FIG. 14B.

Figure 14D:
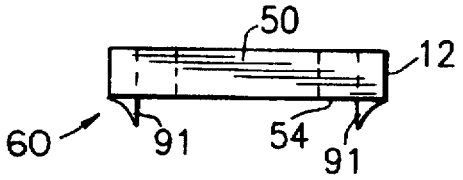

FIG. 14D is a front end view of the structure of FIG. 14C.

Figure 15:
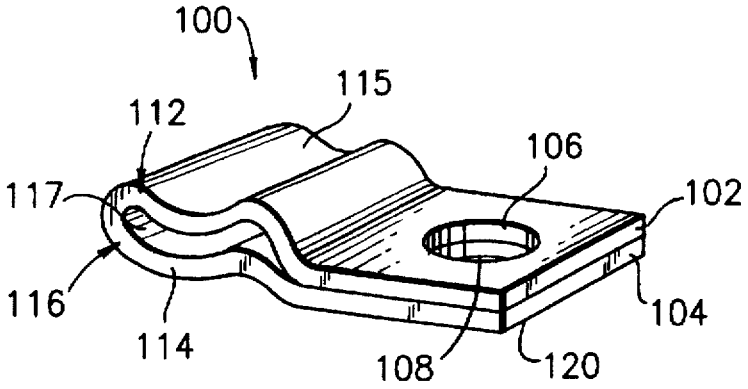

FIG. 15 is a perspective view of a second embodiment of the connector different from that shown in FIGS. 3–8.

Figure 16:
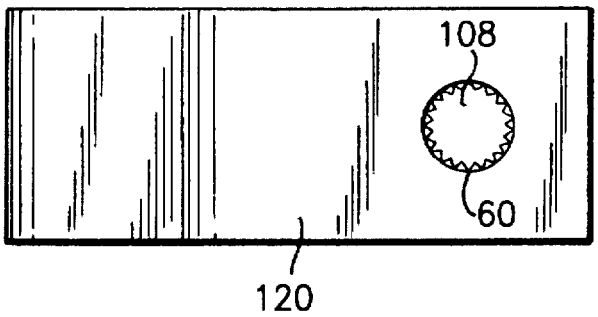

FIG. 16 is a bottom plan view of the connector of FIG. 15.

DETAILED DESCRIPTION OF THE PREFERRED EMBODIMENTS

Referring now to FIGS. 3–8 a lay-in type connector illustrated generally at 10 is shown. The connector is formed from a unitary strip of electrically conductive metal having a uniform thickness th which is bent along its length to create a body portion 3 having an interior confine 7 and integrally connected first and second flange sections 11 and 12 which extend generally laterally outwardly of the body portion 3. The confine 7 is appropriately sized to receive a conductor 5 as is known in the art.

Each of the first and second flange sections 11 and 12 connects to the body portion 3 along a section of the metal strip through opposed neck portions 13 and 15. The neck portions are complimentarily arcuately shaped so that the opposed inner surfaces of the neck portions 13 and 15 mate with one another when the first and second flange sections are brought together.

The body portion 3 of the connector 10 is defined by two parallel spaced side walls 19 and 21 which are integrally connected to a transversely extending top wall section 24. When the first and second flange sections 11 and 12 are in the clamped condition shown in FIG. 5, the top wall section 24 extends substantially parallel to the flange sections while the side walls 19 and 21 extend generally perpendicularly to the flange sections.

Opposite the top wall section 24 and within the confine 7 of the body portion 3 is a cradle section 28 which has a curved surface 30 defined by a radius of curvature RR having a center point C. The curved surface 30 of the cradle section is provided for receiving a conductor therein.

Figure 8:
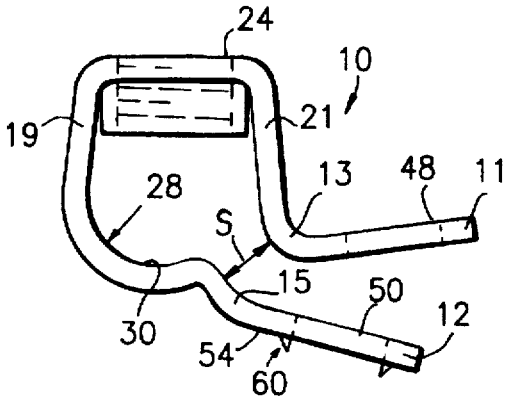
FIG. 8 is a side elevation view of the connector shown in its relaxed unclamped state.

As shown in FIG. 8, the connector 10 has a relaxed state wherein the first and second flange sections 11 and 12 are located in a spread apart condition such that the opposed neck portions 13 and 15 are separated by a spacing S. The spacing S is selected such that it allows the conductor 5 to be laterally inserted past the opposed neck portions and into the confine 7 of the body portion 4 of the connector in its relaxed state. Alternatively, the conductor 5 may be inserted into the connector axially of the conductor length through the open face of the confine 7.

Figure 6:
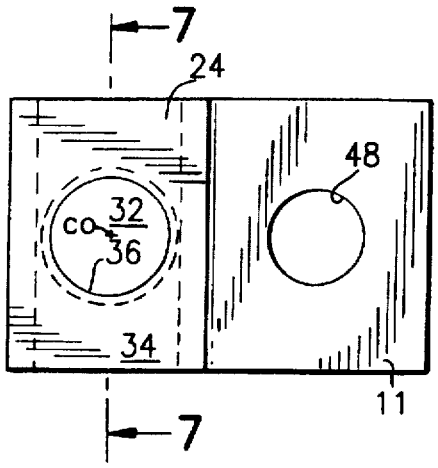
FIG. 6 is a top elevation view of the connector shown in FIG. 5.
Figure 7:
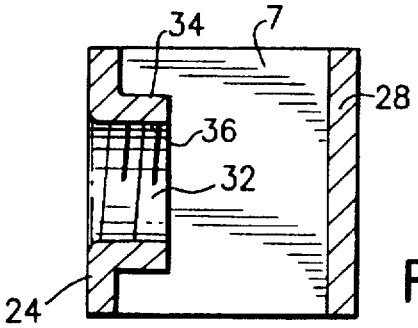
FIG. 7 is a vertical sectional view of the connector shown in FIG. 6 along line 7—7.

As illustrated in FIGS. 6 and 7, the top wall section 24 includes an opening 32 communicating with the confine 7 and is defined by an extruded cylindrical portion 34 of the top wall section 24. Within the interior surface of the cylindrical portion 34 is formed a threaded surface 36 disposed axially around the center CO of the opening 32.

As illustrated in FIG. 4, the threaded opening 32 is correspondingly sized and shaped to receive a threaded set screw 40 therewithin. The set screw 40 is of a length sufficient to extend within the confine 7 of the body portion 3 and has an abutment end 42 which is configured to engage with and clamp the conductor 5 supported on the cradle section 28 of body portion 3. The center CO of the threaded opening 32 is disposed coincidentally with the center C of the curvature radius RR so that the line of action of the set screw 40 acts to evenly press the conductor 5 against the curved surface of the cradle section 28.

The first and second flange sections 11 and 12 of the connector each include an opening 48 and 50, respectively formed therein, for receiving a mounting bolt 51 therein. The flange sections 11 and 12 are correspondingly sized and shaped so that each overlaps the other hence aligning the openings 48 and 50 when the sections are in the clamped condition shown in FIGS. 4 and 5. As discussed previously, the mounting bolt 51 typically threadedly engages within a threaded opening 53 formed in the contact surface 9 as is standard in the industry. Alternatively, the mounting bolt may thread onto a nut located on the other side of the surface 9. The second flange section 12 has an undersurface 54 which confronts the contact surface 9 when the mounting bolt is tightened. The mounting bolt 51 has a shank diameter d1 which is slightly less in size than that of the flange section openings 48 and 50 such that the mounting bolt 51 can be passed through the connector flange sections and be secured within the threaded opening 53 in the contact surface material 9.

Figure 5:
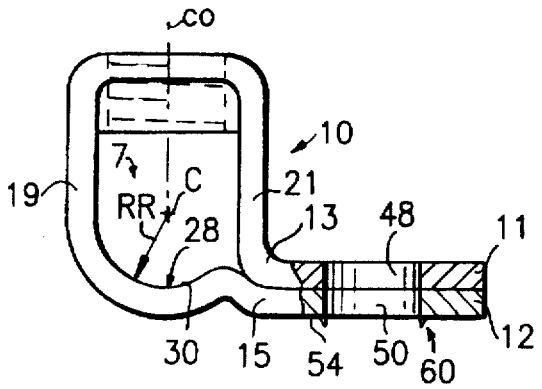
FIG. 5 is a side elevation view showing the connector in its clamped state absent the conductor and the mounting bolt.

The flange sections 11 and 12 are normally disposed in a relaxed spread condition, but as the mounting bolt 51 is threaded into the opening 53 of the contact surface 9, the otherwise spread flange sections 11 and 12 are urged into the overlapping condition illustrated in FIG. 5 and thereupon close off the confine 7. Upon continued turning of the mounting bolt 51, the lower surface 54 of the second flange section 12 is brought into biting nonrotational engagement with the contact surface. A surface scratching means 60 is provided for this purpose and is associated with the opening 50 in the second flange section 12 and is disposed in cooperation with the undersurface 54 thereof. As will become apparent herein, the means 60 may take various forms, but generally is defined by at least one projection which extends outwardly beyond the undersurface 54 of the second flange section 12.

In FIG. 9A, the surface scratching means 60 is shown taking the form of a plurality of star points 62, which are punched through the opening 50 in the second flange section 12 and thereafter bumped down to create the depending projections.

In FIG. 9B, the means 60 is shown taking the form of a plurality of extruded notches 64 formed in the second flange section 12 and disposed radially about the opening 50 and having raised burrs 65 extending outwardly of the undersurface 54 of the second flange section 12.

In FIG. 9C, the means 60 is alternatively shown taking the form of plurality of slots 66 formed radially about and communicating with the opening 50 and having a corner edges 68 which are bumped down toward and beyond the undersurface 54 of the second flange section 12 to create depending projections.

In FIG. 10A, the surface scratching means 60 is shown taking the form of serrated edges 70 formed along opposite lateral sides of the second flange section 12 and having corners 72 which are twisted or bumped down to create the surface scratching anti-rotation elements.

In FIG. 10B, the surface scratching means 60 is shown taking the form of a plurality of oval holes 75 ending in a sharpened edge 77 protruding from the undersurface 54 of the second flange section 12 and disposed circumferentially about the opening 50 in a noncommunicating manner.

In FIGS. 11A through 11D, the surface scratching means 60 may alternatively take the form of a crown shaped penetrating tongue 78 having a plurality of generally triangular shaped teeth 80 depending beyond the undersurface 54 of the second flange section 8. The plurality of crown-shaped teeth are formed by punching the sheet material of the connector through with a die having the triangular teeth shape while simultaneously forming the opening 50.

In FIGS. 12A through 12D, the surface scratching means 60 is shown alternatively taking the form of corner fold down projections 84 disposed at the two end corners of the second flange section 12. The fold down portions 84 extend below the undersurface 54 of the second flange section 12 and are oriented at an angle A relative to the remaining length of the second flange section, with the angle A being equal to approximately 45 degrees. This embodiment takes advantage of the right angle corners of the second flange section to create teeth projecting beyond the undersurface 54.

In FIGS. 13A through 13E, the surface scratching means 60 is alternatively shown taking the form of a curved shaped second flange section 12' having a plurality of serrations 90 formed along lateral side edges thereof. The serrations are formed from punched material ending in downwardly extending teeth 91 disposed below the undersurface 54' of the second flange section 12'. The curved form of the second flange section 121 is yieldable to a flattened state as shown in FIG. 13E wherein the teeth 91 are caused to project into the contact surface upon the continued clamping action of the connecting bolt 51. The yieldable curved form of the second flange section 12' provides a prestressing feature to the connector to enhance the abrading action of the teeth 91.

As an alternative to the curved form shape of the second flange section 8 shown in FIGS. 13A through 13E, the second flange section 12 as shown in FIGS. 14A through 14D may be provided in a flattened unstressed state with the plurality of teeth 91 similarly formed by serrations 90 disposed along lateral side edges of the second flange section 12.

Referring now to FIGS. 15 and 16, an alternative embodiment of the connector is shown as 100. The connector 100 is low profile and is defined by first and second flange sections 102 and 104 each having a through opening 106 and 108 formed therein and a body portion 116 integrally connected thereto. The openings 106 and 108 are co-aligned with one another when the first and second flange sections 102 and 104 are in the overlapping condition shown in the FIG. 15.

The body portion 116 is defined by a wave-like section 112 and a cradle section 114 which are disposed oppositely of one another. The cradle section 114 and the wave-like section 112 together form a conductor receiving confine 117 within the body portion 116 of the connector 100. The wave-like section 112 is defined by a downwardly turned ridge 115 which extends transversely across of the connector and forms a depression in the body portion 116 for causing the inserted conductor to be closely contacted by the wave section upon the continued tightening of the mounting bolt 51 without the need of a set screw.

The illustrated connector 100 in FIGS. 15 and 16 is shown in its clamped state absent the mounting bolt which causes the first and second flange sections to move together from their otherwise spread apart condition much in the same way as discussed with reference to the illustrated connector in FIG. 8. Also, as illustrated in FIG. 16, the undersurface 120 of the second flange section 104 includes the surface scratching means 60 which may be identical to one of the means disclosed above with respect to embodiments shown in FIGS. 9 through 14. Therefore, the connector of FIG. 15 should be understood as having completely the same surface scratching capabilities as that discussed with reference to the connector shown in FIGS. 3–8.

By the foregoing, an improved electrical connector with surface scratching capabilities is shown. However, numerous modifications and substitutions may be had without departing from the spirit of the invention. For example, the terms "depending" or "upwardly extending" are used only as reference devices and are not meant to limit the structure of the connector to these relative directions. Also, the threaded opening 32 in the top wall section 24 need not be formed using a cylindrical extrusion, but rather may take the form of a tapped hole in the section.

Accordingly, the invention is described by way of illustration rather than limitation.

We claim:

1. An electrical lay in type connector comprising:

a strip of sheet metal formed to define a body portion having an interior confine and first and second flange sections extending from the body portion, said first flange section and said second flange section each having a through opening formed therein substantially of the same diameter and being aligned with one another when said first and second flange sections are in an overlapping arrangement;

one of said first and second flange sections defining an undersurface of the connector and having surface scratching means disposed proximate the opening therein and depending beyond the undersurface;

said openings in said first and said second flange sections being adapted to receive a bolt which threads into a threaded opening associated with a contact surface, with said surface scratching means engaging the contact surface when the bolt is tightened;

wherein said body portion is being defined by two spaced apart vertically extending side walls connected to one another by a top wall section having a threaded opening communicating with the interior confine and one of the said first and second side walls being contiguously formed with a cradle section having a curved surface which is disposed oppositely of said threaded opening of said top wall section.

2. A connector as defined in claim 1 further characterized in that said curved surface of said cradle section has a center of curvature generally coincident with the center of the opening formed in the top wall section.

3. A connector as defined in claim 1 further characterized by said first and second flange sections connect to said body portions through complimentarily shaped neck portion.

4. A connector as defined in claim 3 further characterized in that said opening formed in said top wall section is an extruded cylindric shape of said strip of sheet material which extends downwardly into said internal confine of said body portion.

5. A connector as defined in claim 4 further characterized in that said strip of sheet material is formed such that said first and said second flange sections are held in a spaced apart relationship in the relaxed state of the connector.

6. A connector as defined in claim 5 further characterized in that said surface scratching means includes a plurality of teeth which are folded down from the corners of said one of said first and second flange sections downwardly beyond said undersurface.

7. A connector as defined in claim 1 further characterized in that said connector is a low profile connector having a body portion defined by a cradle section and an opposed wave-like section which defines the internal confines of the connector, said wave-like section having a ridge which extends into said internal confines of said body portion for engaging a conductor which is inserted therein.

8. A connector as defined in claim 7 further characterized in that said first and second flange sections have a relaxed spaced apart condition wherein each is spaced from the other a distance sufficient to permit the passage of a conductor therethrough.

9. An electrical lay in type connector comprising:

a strip of sheet metal formed to define a body portion having an interior confine and first and second flange sections extending from the body portion, said first flange section and said second flange section each having a through opening formed therein substantially of the same diameter and being aligned with one another when said first and second flange sections are in an overlapping arrangement;

one of said first and second flange sections defining an undersurface of the connector;

said openings in said first and said second flange sections being adapted to receive a bolt which threads into a threaded opening associated with a contact surface;

wherein said body portion being defined by two spaced apart vertically extending side walls connected to one another by a top wall section having a threaded opening communicating with the interior confine and one of the said first and second side walls being contiguously formed with a cradle section having a curved surface which is disposed oppositely of said threaded opening of said top wall section.

10. A connector as defined in claim 9 further characterized by said first and second flange sections connect to said body portions through complimentarily shaped neck portion.

11. A connector as defined in claim 10 further characterized in that said strip of sheet material is formed such that said first and said second flange sections are held in a spaced apart relationship in the relaxed state of the connector.

12. A connector as defined in claim 11 further characterized int hat said opening formed in said top wall section is an extruded cylindric shape of said strip of sheet material which extends downwardly into said internal confine of said body portion.

* * * * *